US006307133B1

(12) United States Patent
May et al.

(10) Patent No.: US 6,307,133 B1
(45) Date of Patent: Oct. 23, 2001

(54) DRUMHEAD DAMPENING DEVICE

(75) Inventors: James H. May, Palmdale; Christopher J. Whittington; Dave Weckl, both of Chatsworth, all of CA (US)

(73) Assignee: Remo, Inc., Valencia, CA (US)

( * ) Notice: Subject to any disclaimer, the term of this patent is extended or adjusted under 35 U.S.C. 154(b) by 6 days.

(21) Appl. No.: 09/699,177

(22) Filed: Oct. 30, 2000

Related U.S. Application Data

(60) Provisional application No. 60/220,252, filed on Jul. 24, 2000.

(51) Int. Cl.[7] ..... G10D 13/02
(52) U.S. Cl. ..... 84/411 M; 84/422.3; 181/161
(58) Field of Search ..... 84/411 M, 422.3, 84/421, 453; 181/166, 207, 208

(56) References Cited

U.S. PATENT DOCUMENTS

| | | | | |
|---|---|---|---|---|
| 590,182 | * | 9/1897 | Bower | 84/411 M |
| 3,951,032 | * | 4/1976 | LaPorta et al. | 84/411 |
| 5,763,797 | * | 6/1998 | Loendorf | 84/411 M |
| 5,877,440 | * | 3/1999 | Chaffee et al. | 84/411 M |
| 5,959,227 | * | 9/1999 | Shapiro | 84/411 M |
| 5,986,197 | * | 11/1999 | Allen | 84/411 M |

* cited by examiner

*Primary Examiner*—Bentsu Ro
*Assistant Examiner*—Kim Lockett
(74) *Attorney, Agent, or Firm*—Rapkin & Gitlin; Larry F. Gitlin, Esq.

(57) ABSTRACT

A device for use in combination with a musical drum for dampening extraneous and undesirable tones produced by the drumhead consisting of a means for affixing the device to the drum, such as, for example, a clamp assembly, mounted on a counterhoop. Connected to the clamp assembly is an L-shape bracket, which extends generally above the clamp and over a section of the edge portion of the drumhead surface where it attaches in pivotal relation to a horizontally extending arm, which is connected on its opposite end to a casing. An aperture is formed within the casing and extends entirely from the top end of the casing to the bottom. A vertically disposed plunger arm is slidably received through the aperture, and is connected at the bottom end to a plunger head, which includes a base portion and a felt pad or some similarly suitable material mounted thereon to act as the contact surface with the drumhead. Attached to the plunger arm at points above and below the casing are restraining mechanisms or O-rings provided to adjust "gate time," i.e. the time interval the plunger head exists off the drumhead in response to an object striking the drumhead surface. A rotatable nut is employed to level the plunger head relative to the drumhead surface.

7 Claims, 2 Drawing Sheets

DRUMHEAD DAMPENING DEVICE this application claims benefit of Provisional application Ser. No. 60/220,252 filed Jul. 24, 2000.

BACKGROUND OF THE INVENTION

1. Field of the Invention

The present invention relates generally to the area of musical instruments. More particularly, the invention is directed to a drumhead and a device for adjustably dampening the undesirable sounds produced by a drumhead to provide an effective musical tone.

2. Description of the Prior Art

Drumhead dampening devices, also known as internal and external tone controls, have existed in the prior art for many years. Internal tone controls typically are mounted inside the drumshell with a pressure adjustment knob or actuator element mounted through the shell wall to give the musician easy access to operate the device. The internal tone control employs a head element with a felt pad or some other suitable object that presses against the underside of the drumhead, which effects the dampening or "cutting off" of the sound. External tone control devices have the same ultimate effect, i.e. to dampen the sound from the drumhead, though this version of the device employs an external mount, which may be attached to any suitable component of the drumshell, such as the counterhoop. Instead of the head element or pad pressing against the underside of the drumhead, as with the internal control, pressure is exerted from above, upon the drumhead's upper surface. The actuator can be an external lever, a knob or any other suitable device. With both versions, the actuator must be manually operated by the drummer to lock the felt pad or some other suitable element in place against the drumhead. The pressure exerted by these devices is constant. Neither device provides the pad the means to be automatically adjusted to the musician's requirements to selectively eliminate undesirable tones at various times during play. Specifically, prior art tone control devices lack the means to adjust the pressure of the pad against the drumhead surface or the location of the pad on the surface once the device is situated. Maximum dampening is achieved when the pad is positioned near the center of the drumhead. Minimum dampening is achieved when the pad is positioned near the edge of the drumhead. Yet, the prior art devices are without the means to accomplish even this seemingly simple adjustment.

Accordingly, there is a need in the art to provide a dampening device for a drumhead that has an external mounting feature with the means to easily adjust the location of the pad that presses against the drumhead surface, adjust the amount of pressure the pad exerts on the drumhead surface, and adjust the time interval ("gate time") the pad exists off the drumhead surface in response to an object striking the surface. The device should also be easy to mount on an external component of the drum, such as the counterhoop, simple to remove and easy to operate without any significant interference with the playing of the instrument.

SUMMARY OF THE INVENTION

The present invention provides a device for use in combination with a musical drum for dampening extraneous and undesirable tones produced by the drumhead. The invention consists of a means for affixing the device to the drum, such as, for example, a clamp assembly, mounted on a counterhoop. Connected to the clamp assembly is an L-shape bracket, which extends generally above the clamp and over a section of the edge portion of the drumhead surface where it attaches in pivotal relation to a horizontally extending arm. This horizontal arm is connected on its opposite end to a casing. An aperture is formed within the casing and extends entirely from the top end of the casing to the bottom. A vertically disposed plunger arm is slidably received through the aperture, and is connected at the bottom end to a plunger head. The plunger head includes a base portion and a felt pad or some similarly suitable material mounted thereon to act as the contact surface with the drumhead.

Attached to the plunger arm at points above and below the casing are restraining mechanisms or O-rings provided to adjust "gate time," i.e. the time interval the plunger head exists off the drumhead in response to an object striking the drumhead surface. The "gate time" is determined by adjusting the bottom O-ring. The lower down on the plunger arm the O-ring is set, the greater the "gate time." The higher up on the plunger arm the bottom O-ring is set, the lesser the "gate time." In combination with the L-shape bracket and the horizontal oriented arm of the clamp mechanism is a rotatable nut, which is employed to level the plunger head relative to the drumhead surface.

Accordingly, an object of the present invention is to provide a device that selectively dampens undesirable drumhead ring.

Another object of the present invention is to provide an externally mounted device for dampening undesirable drumhead ring.

Another object of the present invention is to provide a device for dampening undesirable drumhead ring that can adjust to various positions on the drumhead surface to minimize or maximize the dampening effect.

Still another object of the present invention is to provide a device for dampening undesirable drumhead ring with the means to adjust the level of the plunger head relative to the drumhead surface.

Still another object of the present invention is to provide a device for dampening undesirable drumhead ring with the means to adjust the "gate time," which is the time interval the plunger head exists off the drumhead in response to an object striking the head surface.

Still yet another object of the present invention is to provide a device for dampening undesirable drumhead ring that is easy for the musician to operate while playing the instrument.

Still yet another object of the present invention is to provide a device for dampening undesirable drumhead ring that is easy and cost effective to manufacture.

Other objects and advantages of the present invention will become apparent in the following specifications when considered in light of the attached drawings wherein a preferred embodiment of the invention is illustrated.

DETAILED DESCRIPTION OF THE PREFERRED EMBODIMENT

Figure 1:
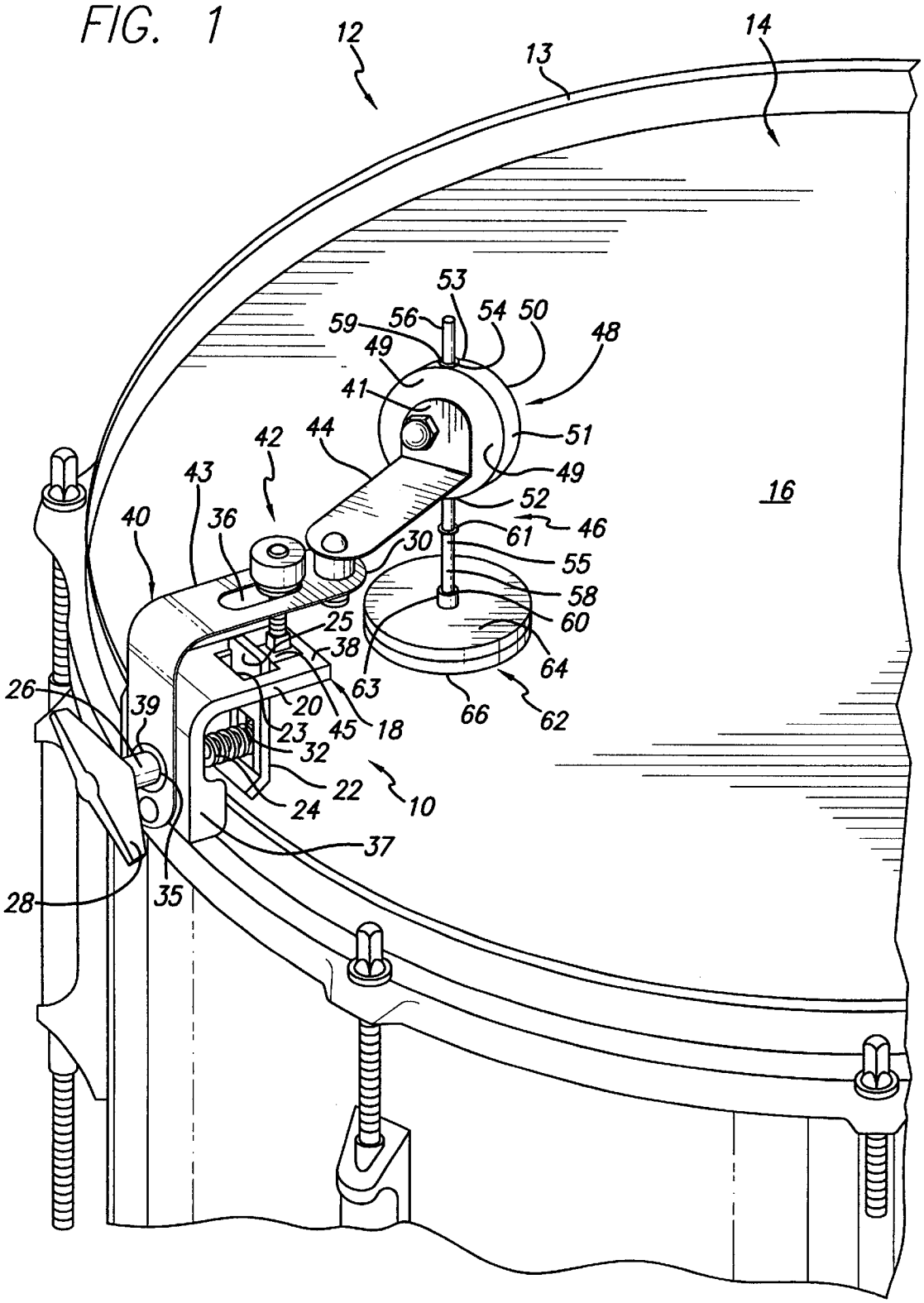
FIG. 1 is a perspective view of the device in accordance with the present invention.
Figure 2:
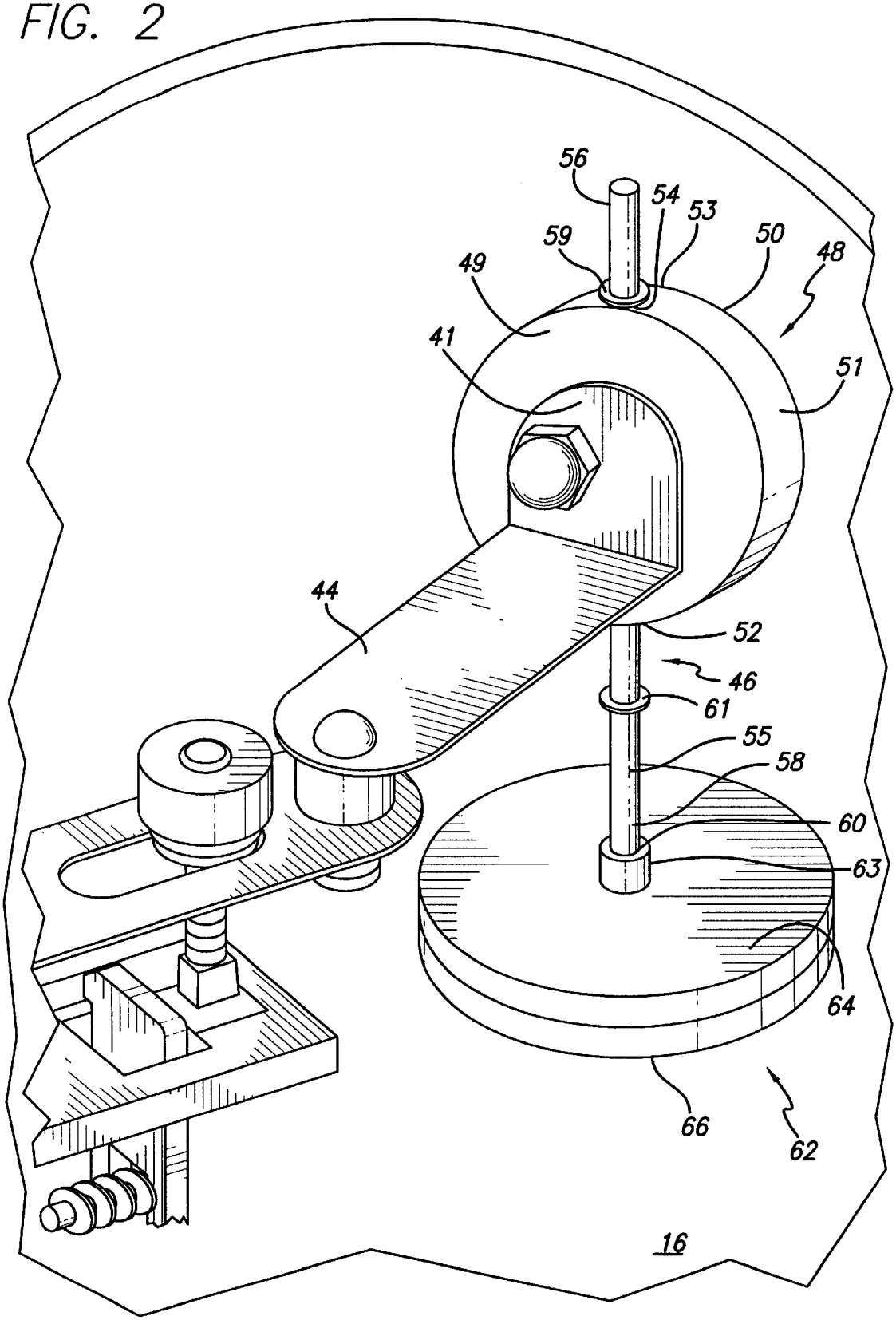
FIG. 2 is an enlarged perspective of the plunger assembly and related components in accordance with the present invention.

The preferred embodiment of the present invention, as shown in FIGS. 1 and 2, provides a device 10 for use in combination with a musical drum 12, typically a snare drum, which includes a counterhoop 13, and a drumhead 14 having a drumhead surface 16. Clamp assembly 18 or any other suitable means is employed to affix device 10 to any appropriate mounting structure on drum 12, such as, for example, counterhoop 13. Clamp assembly 18 includes an L-shape clamp bracket 20, clamp bracket member 22, spring 24 tightly wound around wing bolt 26, which includes wing head 28. Aperture 32, which can be threaded, or a threaded nut (not shown) is provided to assist in tightening clamp assembly 18 to secure device 10 to drum 12. Apertures 35 and 36 are formed in vertical member 37 and in horizontal member 38, respectively, of L-shape clamp bracket 20. Aperture 23 is formed within horizontal member 38, and receives end 25 of clamp bracket member 22. L-shape member 40, which extends around and then over L-shape bracket 20, is secured to L-shape bracket 20 in any conventional manner, such as by soldering to bind the components together, bolting the two parts together, or by using any other suitable means for this purpose. Aperture 39 is formed within L-shape member 40 in alignment with aperture 35. Wing bolt 26 is inserted through apertures 35 and 39 and then through aperture 32, where wing bolt 26 is fixed. Rotating wing head 28 clockwise tightens the vice grip created by forcing the convergence of vertical member 37 and clamp bracket member 22 to secure device 10 to drum 12. Nut and bolt assembly 42 is disposed through aperture 36 and aperture 45, and provided as the means to adjust the level of plunger head 62 relative to drumhead surface 16.

Attached to the end 30 of horizontal member 43, by any conventional means of attachment, is arm member 44. Arm member 44 is connected to member 43 in rotational relation along a horizontal plane parallel to drumhead surface 16. Arm member 44 is provided to enable plunger assembly 46 to be positioned in various locations on drumhead surface 16 to vary the effects of the tone dampening.

Member 41, which is integrally formed at a right angle relative to member 43, connects to casing 48, which is shown in the drawings as a circular shaped object. Casing 48 can be configured differently, as design requirements or specifications dictate. Casing 48 includes generally flat sides 49 and 50 and a continuous circumferential flat edge 51. Disposed vertically through the center of casing 48 from the bottom edge 52 to the top edge 53, and therethrough, is aperture 54. Plunger assembly 46 comprises plunger arm 55 and plunger head 62. Plunger arm 55 is disposed in slidable relation through aperture 54, and includes plunger arm top section 56 and plunger arm bottom section 58. Connected to end 60 of plunger arm 55 is plunger head 62, which includes fitting 63 to receive and secure end 60, a base portion 64 and contact surface 66. Plunger head 62, or base portion 64 by itself, can be weighted or increased or decreased in size as a further means of adjusting the "gate time." Contact surface 66 may be comprised of a felt pad or any other material suitable for the intended purpose. Affixed around predetermined points along plunger top section 56 and plunger bottom section 58 are O-rings 59 and 61, respectively, made of synthetic or natural materials, or any other means suitable to inhibit the vertical movement of plunger arm 55 relative to drumhead surface 16.

Components employed for device 10 are comprised of either metal alloy, such as aluminum or steel, natural material, such as rubber, resilient material or synthetic materials, such as polyethylene, or a combination of these.

In practice, device 10 is secured tightly to counterhoop 13 by employing clamp assembly 18. Plunger assembly 46 is positioned by the musician at a selected location on the drumhead surface 16. O-ring 59 is adjusted near the top of plunger arm 55 to enable plunger head 62 to rest easily on the drumhead surface. Using nut and bolt assembly 42, plunger head 62 is adjusted to a level position relative to the drumhead surface 16. The "gate time" is then selected by adjusting the positions of O-ring 61 along bottom section 58 of plunger arm 55. Raising O-ring 61 will minimize the "gate time," while lowering O-ring 61 will maximize it.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A device for dampening sounds produced by a drumhead of a musical drum having a drum shell and a counterhoop, comprising a means to mount said device an said counterhoop a first supporting arm member affixed to said mounting means a second supporting arm member affixed to said first supporting arm member in rotatable relation therewith a casing member attached to an end of said second supporting arm member, said casing member having an upper end and a lower end and an aperture therethrough extending from said lower end to said upper end a plunger arm slidably disposed through said aperture having a first portion extending above said upper end of said casing member and a second portion extending below the lower end of said casing member a plunger head attached to said plunger arm a first retainer means affixed to said first portion of said plunger arm and a second retainer means affixed to said second portion of said plunger arm, said first and second retainer means being positionally slidable along the respective portions of said plunger arm to which said first and second retainer means are affixed to enable said first retainer means to incrementally adjust the pressure applied by said plunger head upon the drumhead and said second retaining means to adjust the time interval the plunger head exists off the drumhead in response to an object striking the drumhead surface.

2. The invention of claim 1 including means to adjust the level of said plunger head relative to said drumhead.

3. The invention of claim 1 wherein said plunger head comprises a base portion and a pad portion.

4. The invention of claim 3 wherein said pad portion is comprised of a resilient material.

5. The invention of claim 1 comprising the means to rotate said plunger head from an area generally adjacent to the center of said drumhead to an area adjacent the edge of said drumhead contiguous to said counterhoop to adjust the amount of said sound dampening.

6. The invention of claim 1 wherein said means to mount said device on said counterhoop comprises an adjustable clamping mechanism.

7. The invention of claim 1 wherein said first and second retainer means comprise O-rings.

* * * * *